United States Patent [19]

Hammond et al.

[11] 4,020,967

[45] May 3, 1977

[54] COLLAPSIBLE CONTAINER

[75] Inventors: Ronald D. Hammond; Dwight E. Nichols, both of Beatrice, Nebr.

[73] Assignee: Hoover Ball and Bearing Company, Saline, Mich.

[22] Filed: Sept. 15, 1975

[21] Appl. No.: 613,082

[52] U.S. Cl. ..... 220/6; 220/1.5; 220/4 F; 206/511

[51] Int. Cl.[2] ..... B65D 7/24; B65D 7/00; B65J 1/02; B65D 21/00

[58] Field of Search ..... 220/6, 1.5, 4 F; 206/503, 504, 505, 511, 517

[56] References Cited

UNITED STATES PATENTS

| | | | |
|---|---|---|---|
| 2,666,552 | 1/1954 | Coit, Jr. | 206/511 |
| 2,785,823 | 3/1957 | Zarges | 220/6 |
| 3,374,915 | 3/1968 | Verhein et al. | 220/4 F |
| 3,760,970 | 9/1973 | Lutz | 206/511 X |
| 3,809,278 | 5/1974 | Csumrik | 220/4 F |

*Primary Examiner*—William Price
*Assistant Examiner*—Steven M. Pollard
*Attorney, Agent, or Firm*—Olsen and Stephenson

[57] ABSTRACT

A collapsible container for storing and transporting bulk material, particularly baled rubber, and the like, comprising independent floor and wall members which can readily be moved between container forming and knockdown positions. In the container-forming positions of the wall members, a container of substantial capacity is formed and in the knock-down position of the walls, the container can be stocked so that several containers can be transported in a minimum transportation space. The floor is provided, adjacent its periphery, with an arcuate groove and the walls are provided at their bottom ends with complimentary shaped projections which pivotally interfit within the floor groove to facilitate quick and easy movement of the walls between upright container forming positions and horizontal knock-down positions. Releasable latches are provided at the upper corners of the container to connect adjacent walls together. The container has supporting legs which are constructed to facilitate stacking of a number of containers and to provide confined spaces between the stacked containers in which the side walls can be stored.

5 Claims, 11 Drawing Figures

FIG. 7
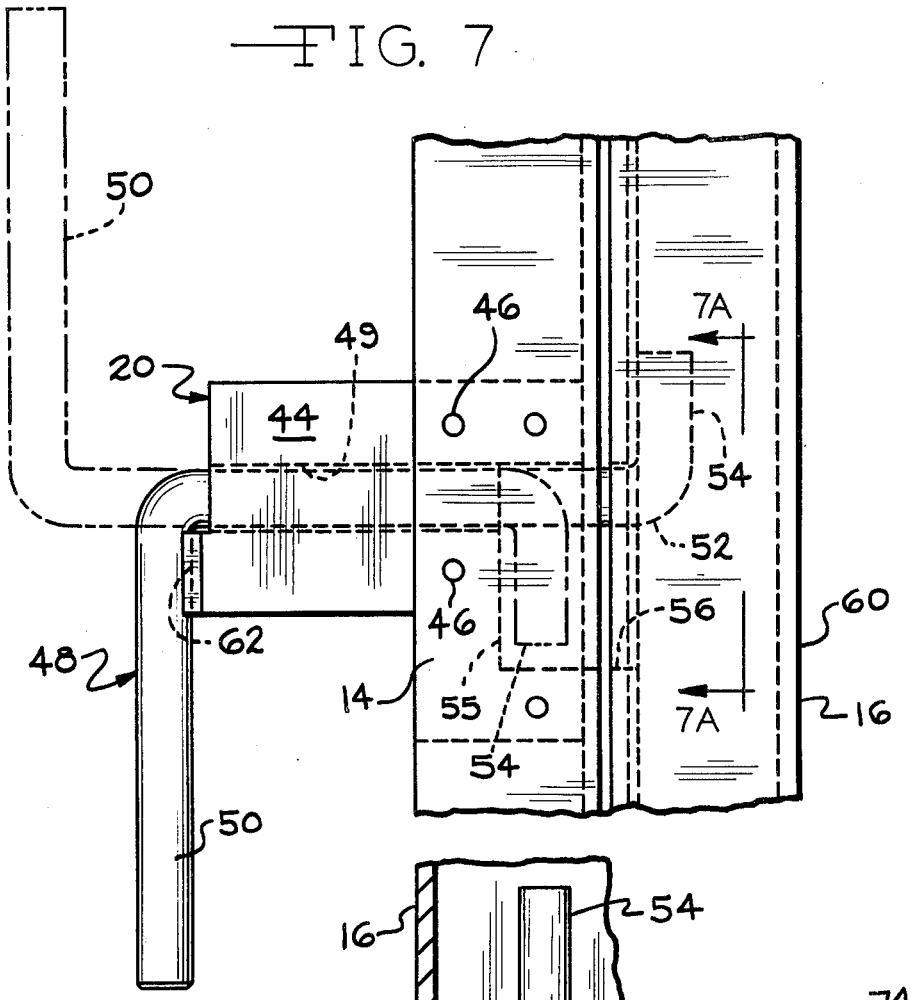
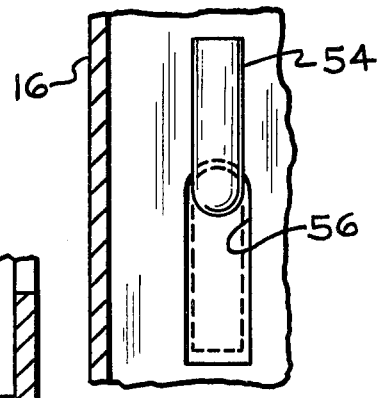
FIG. 7A
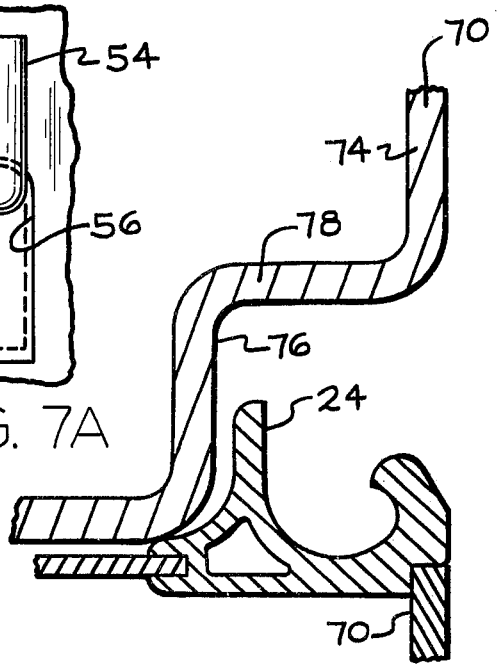
FIG. 6
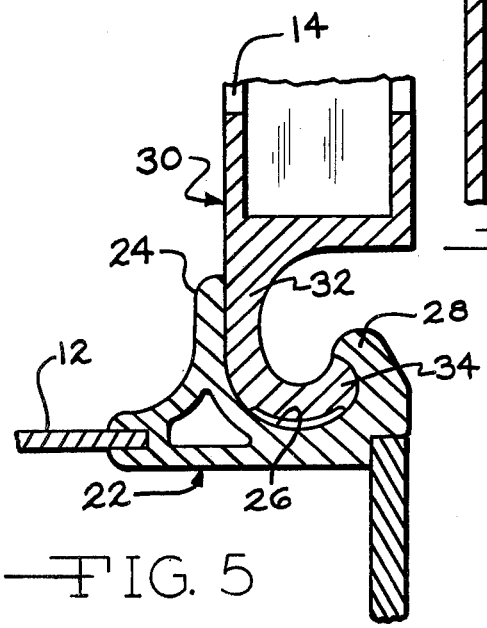
FIG. 5

COLLAPSIBLE CONTAINER

BACKGROUND OF THE INVENTION

In the bulk materail handling industry, a container which can be transported efficiently and which can then be returned empty in a minimum of space, thereby limiting transport costs, has long been desired. It is the object of the present invention, therefore, to provide an improved collapsible container of the type usable in the bulk material handling industry.

SUMMARY OF THE INVENTION

The collapsible bin of this invention comprises a floor member and independent side and end walls. Each of the walls is provided at its lower edge with an irregularly shaped projection and the floor is provided at the outer edge thereof with a groove shaped complimentary to the shape of the projections on the lower ends of the walls. The projections interfit in the grooves so that the walls can be pivotally moved between horizontal and upright positions with respect to the floor. In the upright positions of the walls, the projections are interlocked in the grooves so that the walls are firmly supported on and secured to the floor. However, in the horizontal positions of the wall members, they are readily disengaged from the floor so that they can be in turn stacked on the floor for transport and return of the empty container to the point of origin.

A novel latch structure is provided on each pair of perpendicularly adjacent walls for locking the walls together in the upright container forming positions of the walls.

The floor members are provided with depending legs to facilitate stacking of knocked-down containers with spaces between adjacent floor members in the stack. These spaces provide confined storage areas for the side and end walls when they are stacked on the floor members.

In one embodiment of the invention, a cover is provided for the bin and in the knock-down condition of the container, the cover interfits with the floor groove so as to confine the stacked end walls against movement relative to the floor. In all embodiments of the invention, the legs on the floor members restrain the side walls from moving off supported positions on the floor member during transport of the container in a knock-down condition.

The container of this invention thus provides a sturdy bin capable of storing or transporting a substantial amount of bulk material, when the bin floor and walls are in a container forming position. The container is readily disassembled and placed in a knock-down condition for transport of several stacked, knock-down containers, thereby facilitating economical return of containers for subsequent use in transporting bulk material.

Further objects, features and advantages of this invention will become apparent from a consideration of the following description, the appended claims, and the accompanying drawing in which:

FIG. 5 is a fragmentary detail section view like FIG. 4, as seen from substantially the line 5—5 in FIG. 1, showing the bin side wall in an upright position with respect to the floor;

FIG. 6 is a fragmentary detail sectional view of the floor member in the container of this invention, showing the leg of another container stacked thereon;

FIG. 7 is a detail sectional view of the latching mechanism of the invention showing the latching mechanism in locking position in solid lines and unlocking positions in broken lines;

FIG. 7A is a fragmentary sectional view of a portion of the container of this invention, as seen from the line 7A—7A in FIG. 7 showing a portion of the latching mechanism in locking position in solid lines and in release position in broken lines;

Figure 1:
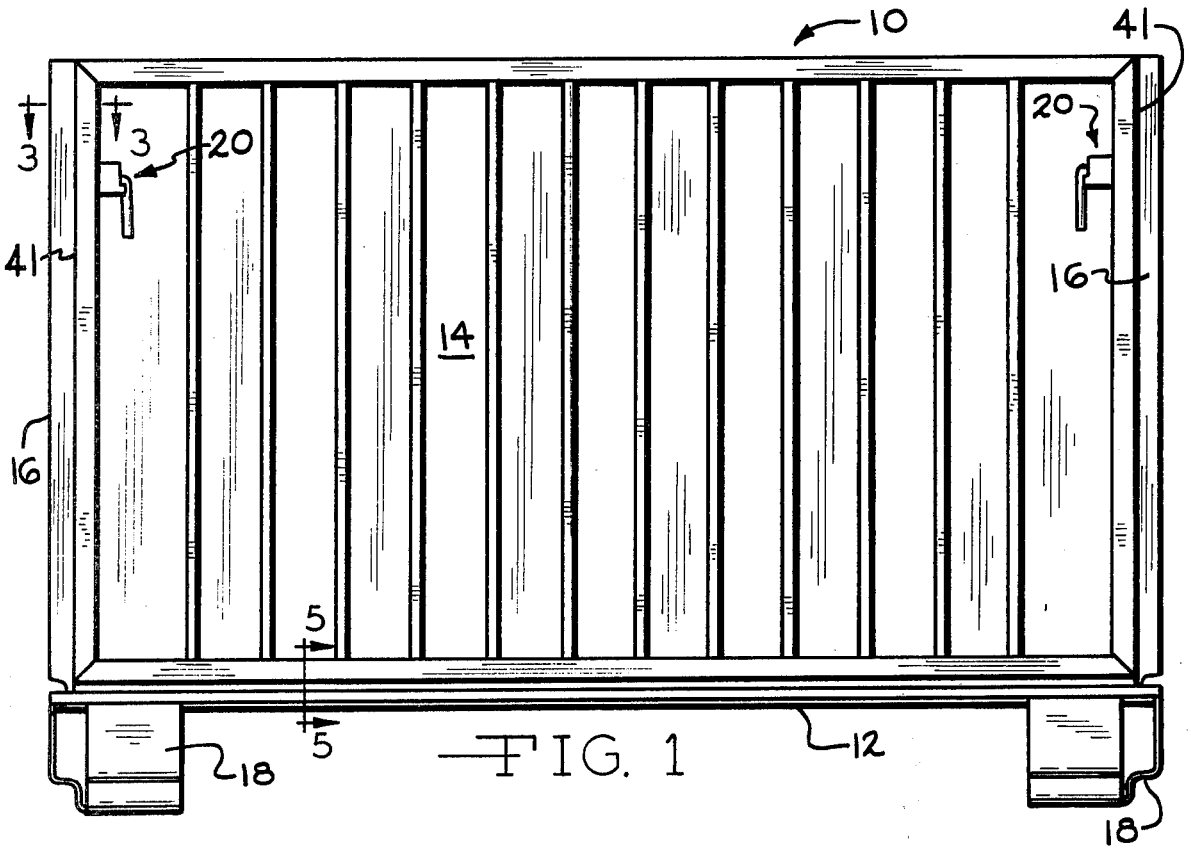
FIG. 1 is a side elevational view of the collapsible container of this invention showing the container walls and floor assembled in container-forming positions.

With reference to the drawing, the bin of this invention, indicated generally at 10, is illustrated in FIG. 1 as including a floor 12, of generally rectangular shape, side walls 14 and end walls 16. Depending legs 18 are provided at the corners of the floor 12. The walls 14 and 16 are pivotally movable on the floor 12 to the container forming upright positions shown in FIG. 1. In this position of the walls, perpendicularly adjacent side and end walls 14 and 16 are releasably connected together by latch assemblies 20.

Figure 4:
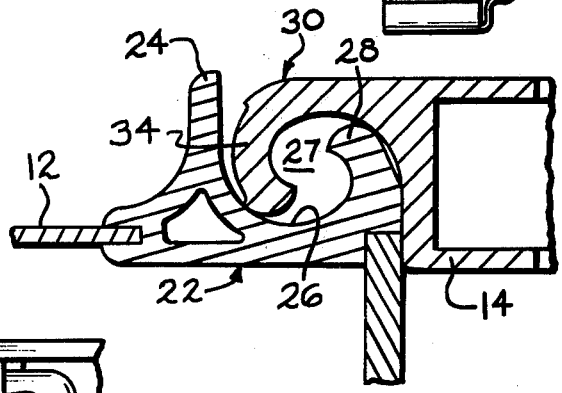
FIG. 4 is an enlarged fragmentary detail sectional view of a lower portion of the container of this invention, showing one of the bin side walls in a pivoted position relative to the container floor to enable disassembly of the wall from the bin.

The floor member 12 has a groove forming extrusion 22 secured to its outer edge as shown in FIGS. 4 and 5. The extrusion 22 includes an upright flange 24, spaced inwardly from the outer edge of the extrusion 22, and an arcuate bottom surface 26 which cooperates with the flange 24 to form an upwardly facing groove 27. The arcuate surface 26 terminates in a lip 28 which curves back toward the flange 24 so as to overhang the surface 26.

Each of the walls 14 and 16 is formed at its lower edge with an extrusion 30 which constitutes a downwardly extending irregularly shaped projection. Since the projections 30 at the lower ends of the walls 14 and 16 are identical, only the projection at the lower end of the side wall 14 shown in FIGS. 4 and 5 will be described in detail. The projection 30 includes a downwardly extending leg portion 32 and an outwardly and upwardly curved portion 34 at the lower end of the leg 32. As shown in FIG. 5, when the wall 14 is in its upright container-forming position, the leg portion 32 of the projection 30 extends downwardly along the outer side of the floor flange 24 and the outwardly and upwardly curved portion 34 extends along the groove bottom wall 26 and terminates at a position in engagement with the underside of the lip 28. The lip 28 and the flange 24 thus cooperate to preclude upward movement of the wall 24 and insure that the wall 14 and the floor 12 will be retained in assembly relation.

The wall 14 is readily disassembled from the floor 12, by pivoting the wall 12 outwardly and downwardly, as illustrated in FIG. 4, to move the curved portion 34 to a position out from under the lip 28. In the downwardly moved position of the wall 14 shown in FIG. 4, it can readily be disassembled from the floor 12 by lifting the extrusion 30 out of the groove 27 in the extrusion 22. Conversely, the wall 14 can be readily assembled with the floor 12 by positioning the extrusion 30 as shown in FIG. 4 in the groove 27 and subsequently moving the wall 14 upwardly to the upright position shown in FIG. 5.

Figure 3:
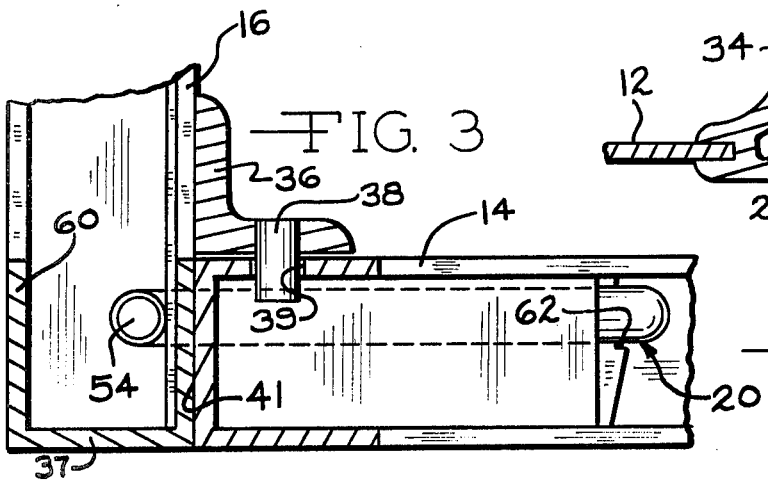
FIG. 3 is an enlarged fragmentary sectional view of a corner of the container of this invention, as seen from substantially the line 3—3 in FIG. 1.

In the assembly of the walls 14 and 16 with the floor 12 to form the container 10, the end walls 16 are first positioned so that the extrusions 30 at the lower ends thereof are positioned in the grooves 27 in the floor extrusions 22 at the ends of the floor 12, as shown in FIG. 4 and the walls 16 are then pivotally moved upwardly to the upright positions such as shown for the wall 14 in FIG. 5. The side walls 14 are similarly assembled with the floor 12. As shown in FIG. 3, each of the end walls 16 is provided, adjacent each of its edges 37, with an inside flange 36, which carries at least one pin 38 that extends toward the perpendicularly adjacent side wall 14. The side wall 14 is in turn provided with a number of openings 39, corresponding to the number of pins 38 on the perpendicularly adjacent end wall 16, and the openings 39 are horizontally aligned with the pins 38. As a result, when the side walls 14 are moved to upright positions, the pins 38 project into the openings 39 to thereby assist in lining up the end walls 16 and the side walls 14 and maintaining the walls in the container forming positions shown in FIG. 1.

Each of the side walls 14 carries a pair of latch assemblies 20, each assembly 20 being mounted adjacent one edge 41 of the wall 14. Each latch assembly 20 includes a body 44 (FIG. 7) secured by bolts 46 to the side wall 14 and provided with a longitudinally extending opening 49. A latch bar 48, having a handle portion 50 and an integral L-shape lock portion 52 is mounted on the body 44. The portion 52 extends through the opening 49 so that it is slidably mounted on the body 44 for movement of the latch bar 48 between the broken line release position and the solid line locking position shown in FIG. 7. In the release position of the latch bar 48 shown in FIG. 7, a hook portion 54 at the end of the lock portion 52 is in a retracted position within a cavity 55 formed in the body 44. In this position of the hook portion 54, the walls 14 and 16 are freely movable relative to each other.

The wall 16 is formed with a slot 56 located in alignment with the cavity 55. As a result, with the walls 14 and 16 in the positions shown in FIG. 7, the lock portion 52 is movable in the opening 49 in a direction from left to right as viewed in FIG. 7, so as to move the hook portion 54 through the slot 56 and into the hollow frame member 60 which forms the adjacent edge of the end wall 16. The handle portion 50 is then rotatable from the upwardly extending position shown in broken lines in FIG. 7 to the downwardly extending position shown in solid lines in FIG. 7 so as to rotate the hook portion 54 to the upright position shown in FIG. 7 out of alignment with the slot 56. This position of the hook portion 54 positively connects the adjacent walls 14 and 16 and maintains the walls 14 and 16 in the assembled container forming positions shown in FIG. 1. The handle 52, in its locking position, slides into a groove 62 formed in the body member 44 so as to preclude accidental movement of the handle 50 from its locking position shown in solid lines in FIG. 7 to its release position shown in broken lines in FIG. 7.

It can thus be seen that the latch assemblies 20 are operable to releasably connect the wall 14 and 16 in the upright container forming positions of the wall to insure the usability of the container 10 for transporting bulk material. When it is desired to disassemble the walls 14 and 16 from the floor 10, for return shipment of an empty container 10, the latch assembly handles 50 are manually moved to the release positions, shown in broken lines in FIG. 7, the hook portions 54 are moved reversely through the slots 56 to their retracted positions in the cavities 55 and the walls 14 and 16 are readily swung downwardly to generally horizontal positions in which they can be disassembled from the floor 12.

Figure 2:
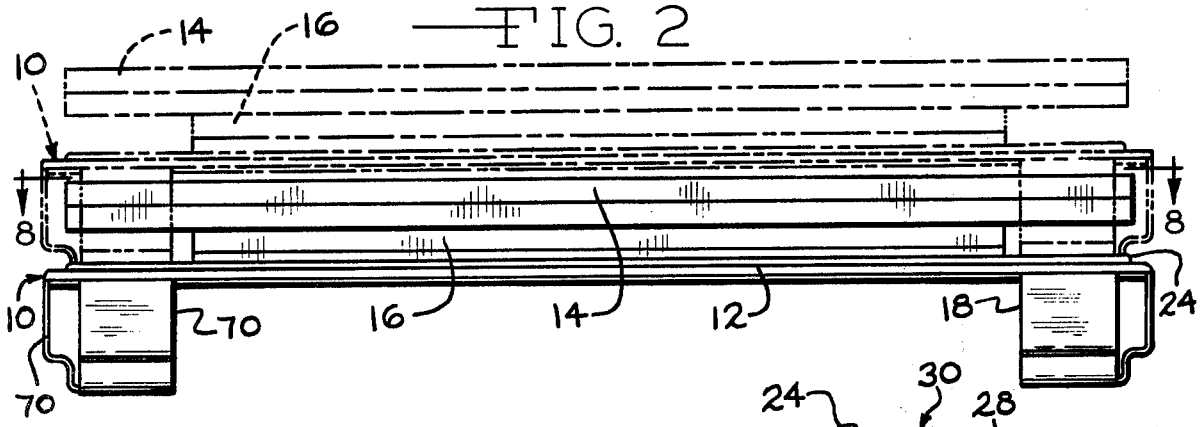
FIG. 2 is a side elevational view of the container of this invention showing the container in knock-down condition and showing a second container in broken lines stacked thereon.
Figure 8:
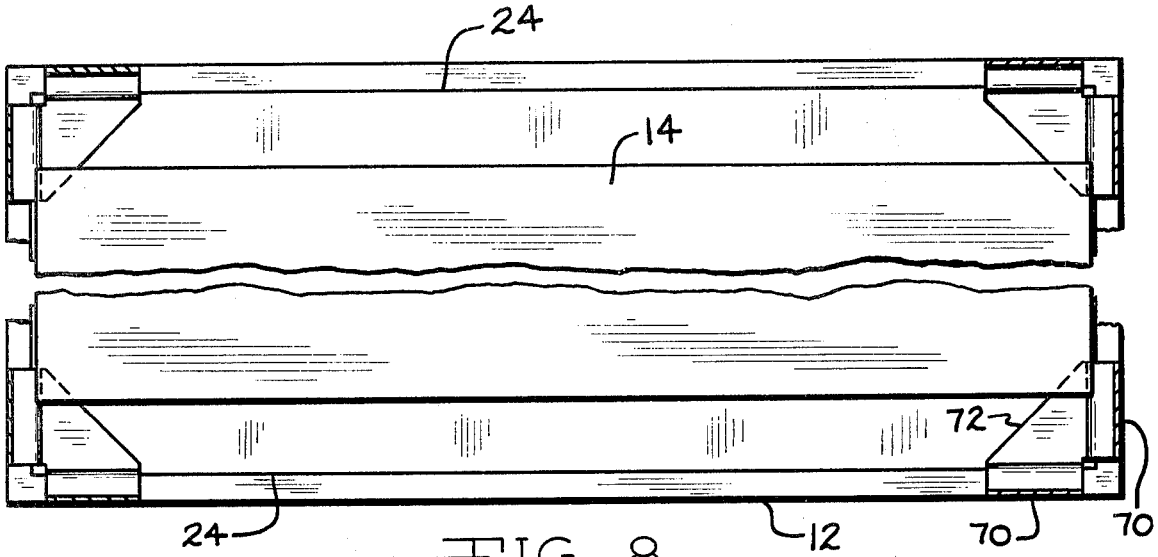
FIG. 8 is a top view, as seen from substantially the line 8—8 in FIG. 2 of stacked containers showing the relationship of the legs on one container to the walls of the container therebelow.

When the walls 14 and 16 have been detached from the floor 12, and it is desired to return the container 10 to its point of origin for refilling, the container 10 is readily shipped in a minumum of space by stacking the walls 14 and 16 on the bottom wall 12, as shown in FIG. 2. As shown in FIG. 2, the end walls 16 are stacked directly on the floor 12 and the side walls 14 are stacked on top of the end walls 16. As shown in FIG. 8, the height of the walls 14 and 16 is such that when they are laid flat on the floor 12, they are inside the floor flange 24 which extends around the periphery of the floor 12. A second container, in a similar knock-down condition, can then be stacked on the lower container, as shown in FIG. 2, so as to block the stacked walls 14 and 16 against sliding movement off the lower floor member 10. As shown in FIGS. 2 and 8, each of the leg members 18 includes a pair of downwardly extending plates 70 which are arranged at right angles relative to each other and are connected at their lower ends by a generally triangular plate 72. As shown in FIG. 6, each downwardly extending plate 70 has a pair of horizontally offset portions 74 and 76 connected by a horizontal portion 78. The portion 76 is dimensioned to fit just inside and adjacent the floor flange 24 to thereby prevent lateral or longitudinal shifting of vertically adjacent containers 10 relative to each other. It is thus apparent that a number of containers 10, in the knock-down positions thereof, can be stacked in the same space occupied by a container 10 when the walls 14 and 16 thereof are in the upright position shown in FIG. 1. Thus, shipment of bulk material one way in the containers 10 and return of the empty containers 10 promotes the economical shipment of bulk material in the containers 10.

Figure 9:
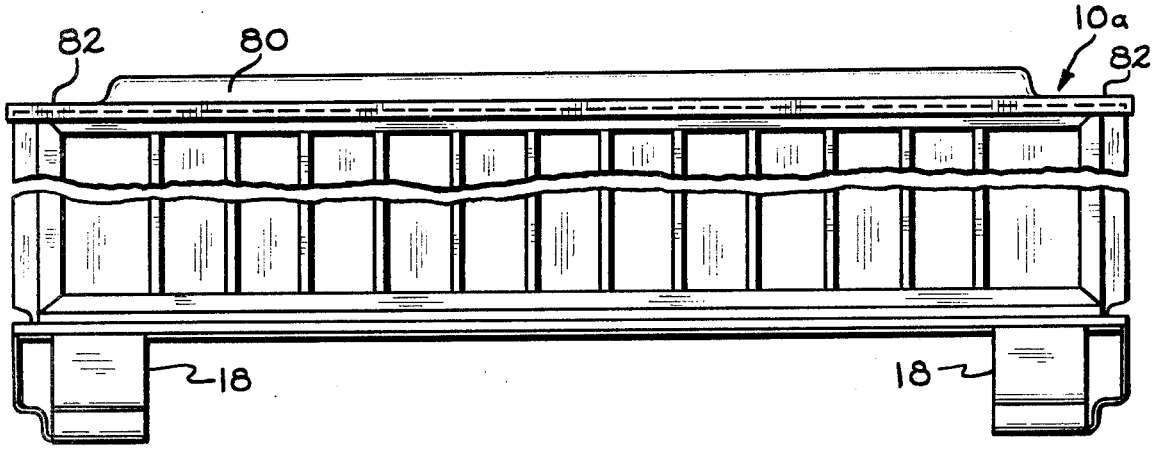
FIG. 9 is a vertically foreshortened side elevational view of a modified form of the container of this invention in which the container is provided with a cover.
Figure 10:
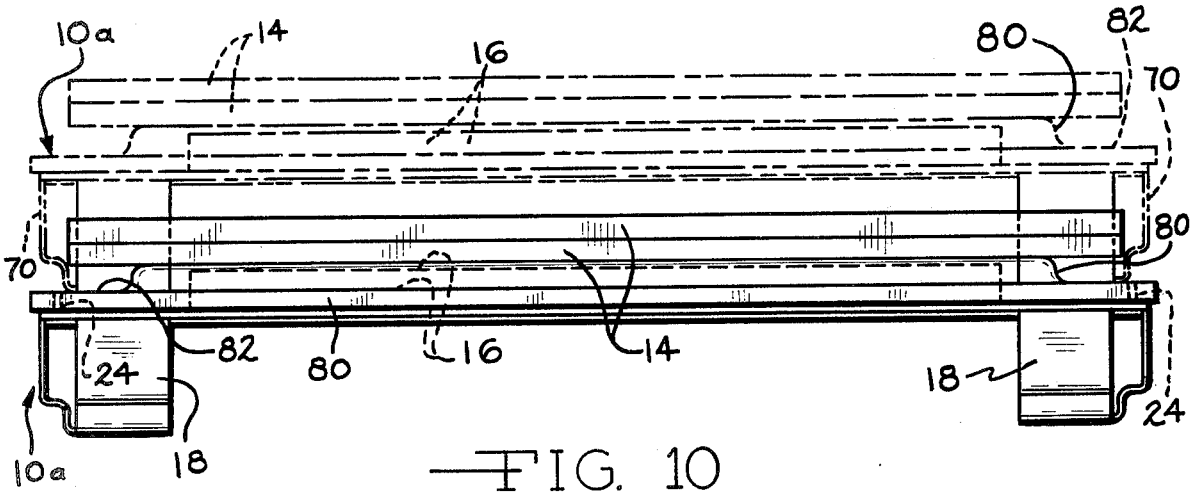
FIG. 10 is a side elevational view of the container shown in FIG. 9, showing the container in a knock-down position and showing a second container in broken lines stacked thereon.

FIGS. 9 and 10 illustrate slightly modified form of the container 10, indicated generally at **10*a*, which is substantially identical to the container 10 except that is provided with a cover 80. The cover 80 fits over the upper ends of the walls 16 and 18 so as to form a top wall on the container 10. Recessed corner portions 82 on the cover 80 are located to provide supports for the legs 18 on a container 10*a* stacked on an identical lower container 10*a*, when the containers are filled with bulk material. The cover 80 is also dimensioned, as shown in FIG. 10, so that in the knock-down condition of the container 10***a*, the cover 80 will telescope over the floor member flange 24 and form with the floor 12 a storage chamber in which the end walls 16 can be stored. The chamber is of a height corresponding to the height of a pair of end walls 16. The side walls 14 are then stacked on top of the cover 80, as shown in FIG. 10, and the next container 10*a* is stacked on the lower container 10*a* so that the depending legs 70 on the upper container rest on the corner portions 82 of the cover 80. Thus, in the container 10, stacking of filled containers is facilitated and the contents of the filled container 10*a* are protected by the cover 80. In all other respects, the container 10*a* is identical to the container 10.

What is claimed is:

1. A collapsible container comprising a floor and side end walls, each of said walls having at the lower edge thereof an irregularly shaped projection having a downwardly extending leg portion and an outwardly and upwardly curved portion at the lower end of said leg portion, said floor having at the outer edge thereof means forming a groove shaped complementary to the shape of said projection, said groove forming means comprising an upwardly extending flange and an arcuate bottom surface at the lower end of said flange extending outwardly and upwardly in a path substantially parallel to said curved portions of said wall projections, said arcuate surface terminating in a lip which overhangs said curved portions of said wall projections so that said wall projections are in interfitting relationship with said groove forming means to thereby form a pivotal connection between said walls and said floor limiting movement of said walls relative to said floor to up and down pivotal movement in all moved positions of said walls in which said lip overhangs said curved portions, each of said walls being pivotally movable outwardly and downwardly to a position in which the projection on the lower end thereof is out from under said lip thereby enabling removal of said wall from a pivotally connected relationship with said floor groove forming means.

2. A collapsible container according to claim 1 further including releasable latch means at the upper corners of said walls operable to secure perpendicularly adjacent walls of said container to each other.

3. A collapsible container according to claim 2 wherein said latch means comprises a body secured to one of said perpendicularly adjacent walls, a latch bar having a handle portion and an integral L-shape lock portion slidably and rotatably mounted on said body, means forming a slot in the other one of said perpendicularly adjacent walls aligned with said lock portion so that said lock portion is slidable into said slot, said handle being operable to rotate said lock portion to a position in which said lock portion projects out of said slot so as to preclude relative movement of said adjacent walls.

4. A collapsible bin according to claim 1 further including depending legs secured to said floor at the corners thereof, each of said legs having a pair of mutually perpendicular upright portions which are below and in substantial vertical alignment with the floor member grooves which intersect at one corner of said floor, and means connecting the lower ends of said leg portions at each corner of said container.

5. A collapsible container according to claim 1 wherein the height of said bin is less than the width thereof and said legs are higher than the combined thicknesses of said side and end walls, thereby enabling stacking of the side and end walls for a container on top of the floor thereof and below the floor of an identical container having legs thereof supported on the floor of the container therebelow.

* * * * *

UNITED STATES PATENT OFFICE

CERTIFICATE OF CORRECTION

Patent No. 4,020,967 Dated May 3, 1977

Inventor(s) Ronald D. Hammond et al.

It is certified that error appears in the above-identified patent and that said Letters Patent are hereby corrected as shown below:

Column 5, line 16, after "side" should read -- and --.

Column 6, line 35, after "having" should read -- the --.

Signed and Sealed this second Day of August 1977

[SEAL]

*Attest:*

RUTH C. MASON
*Attesting Officer*

C. MARSHALL DANN
*Commissioner of Patents and Trademarks*